US005371505A

United States Patent [19]

Michaels

[11] Patent Number: 5,371,505

[45] Date of Patent: Dec. 6, 1994

[54] RADOME TEST SYSTEMS AND METHODS

[75] Inventor: John F. Michaels, East Patchogue, N.Y.

[73] Assignee: Microwave Power Devices, Inc., Hauppauge, N.Y.

[21] Appl. No.: 52,182

[22] Filed: Apr. 22, 1993

[51] Int. Cl.[5] ..... H01Q 3/00

[52] U.S. Cl. ..... 342/360; 324/639

[58] Field of Search ..... 342/360, 165, 170; 343/872; 324/639, 647

[56] References Cited

U.S. PATENT DOCUMENTS 3,936,736 2/1976 Ray .
4,274,048 6/1981 Tricoles et al. .
4,303,211 12/1981 Dooley et al. ..... 343/872
5,066,921 11/1991 Rope et al. ..... 324/639

*Primary Examiner*—Theodore M. Blum
*Attorney, Agent, or Firm*—Kenneth P. Robinson

[57] ABSTRACT

The necessity for returning a repaired nose-mount type aircraft radar radome to a radar test range for recertification is avoided. Data representative of signal transmission characteristics of a repaired area of the radome wall is derived by use of transmission and reflection coefficient determination techniques. A small antenna radiates a test signal through the radome wall and the test signal is then reflected back to the same antenna now operating in a receiving mode. Reflected test signal data is gathered as the spacing of the reflector from the radome wall is successively changed and such data is used to derive signal transmission characteristics. Data representative of such transmission characteristics for a repaired area and a reference area can then be compared in order to detect the presence of out of specification conditions in the repaired area. In other applications, pre-recorded reference data can be used to accomplish certification testing of radomes as part of the manufacturing process. Related test methods are also described.

20 Claims, 3 Drawing Sheets

RADOME TEST SYSTEMS AND METHODS

This invention relates to the testing of radomes for radar systems and, more particularly, to test systems and methods enabling determination of signal transmission characteristics of a radome without utilization of an antenna test range. The invention has particular relevance to the testing of a repaired portion of a radome previously certified for aircraft use.

BACKGROUND OF THE INVENTION

Commercial airliners and other aircraft typically employ a nose-mounted radar antenna for a weather or other radar system. Nose-mounted radomes of fiber glass or other construction substantially transparent to electromagnetic radiation are used to cover and protect such antennas. The required accuracy of azimuth and other data derived in operation of weather radars has necessitated that the transmission characteristics of each radome be subjected to extensive testing on a sophisticated antenna range. Such testing, in order to determine radome transmission efficiency, reflection loss, reflection lobes, beam deflection, beam broadening, sidelobe increase, etc., is both expensive and time consuming.

A radome mounted on the nose of an airliner is subject to in-flight damage from hail, bird strikes, lightning and static electricity, as well as to accidental impact damage while the aircraft is on the ground. Damage to a radome may be sufficient to require its removal and repair. Following such repair, it has typically been necessary to send the radome to an antenna range for testing to assure that the repair (e.g., reconstruction of the radome wall to repair a hole) has not resulted in an area of the radome having transmission characteristics which do not meet the required specifications for reflection loss or other of the characteristics listed above. The advent of weather radar systems having capabilities for detection of windshear conditions has increased the need for adequate testing of radomes, particularly after repair, in view of the areas of increased radar performance necessary for effective detection of conditions indicative of the occurrence of windshear effects.

It is therefore an object of this invention to provide radome test systems and methods enabling radomes to be tested or retested efficiently and accurately without requiring access to an antenna test range.

Additional objects are to provide new and improved radome test systems and methods, and such systems enabling evaluation of transmission characteristics, particularly after removal and repair of a radome previously tested and installed on an aircraft.

SUMMARY OF THE INVENTION

In accordance with the invention, a radome test system, for determining signal transmission characteristics for a selected area of a radome, includes antenna means for providing a radiated test signal and for receiving a reflected test signal. Reflector means, positioned in spaced relation to the selected area of the radome, are provided for intercepting the radiated test signal after it passes through the selected area of the radome and for reflecting the radiated test signal back to the antenna means as a reflected test signal. Positioning means, coupled to the reflector means, enable adjustment of the position of the reflector means relative to the selected area of the radome. Also included is data storage means for storing data representative of signal transmission characteristics for the selected area of the radome based upon reflected test signals received by the antenna means while the reflector means is positioned at a plurality of positions in relation to the selected area of the radome. Comparison means, coupled to the data storage means, enable comparison of data for the selected area to similar data for a reference area, of the radome, which has a symmetrical relationship to the position of the selected area on the radome. Alternatively, signal transmission characteristic data may be compared to standard reference data previously stored for use with the type of radome under test.

Also, in accordance with the invention, a method for determining signal transmission characteristics for a selected area of a radome, comprises the steps of:

(a) radiating a test signal toward the selected area of the radome;

(b) reflecting the test signal from a predetermined first reflection position, after the test signal has passed through the selected area of the radome, to provide a reflected test signal;

(c) receiving the reflected test signal;

(d) storing data representative of the reflected test signal received in step (c);

(e) repeating steps (a) through (d) with the predetermined first reflection position changed to a predetermined second reflection position; and (f) processing the stored data to provide data representative of signal transmission characteristics for the selected area of the radome. Such processing provides data for direct evaluation of the transmission amplitude and phase and of the back-scattered reflection amplitude and phase of the measured section of the radome. To permit a comparative measure of the acceptability of a repaired section, the following steps may be added:

(g) repeating steps (a) through (f) for a reference area having a position on the radome which has a symmetrical relationship to the position of the selected area on the radome; and (h) comparing the data representative of signal transmission characteristics for the selected and reference areas of the radome to identify differences in characteristics for such areas.

For a better understanding of the invention, together with other and further objects, reference is made to the following description taken in conjunction with the accompanying drawings and the scope of the invention will be pointed out in the accompanying claims.

DESCRIPTION OF THE INVENTION

The invention will be described particularly in the context of testing to determine signal transmission characteristics of a previously tested and specification certified aircraft nose-mounted radome which has been damaged, removed from the aircraft and repaired. Other applications for testing or retesting new or undamaged radomes will be addressed later.

Figure 1:
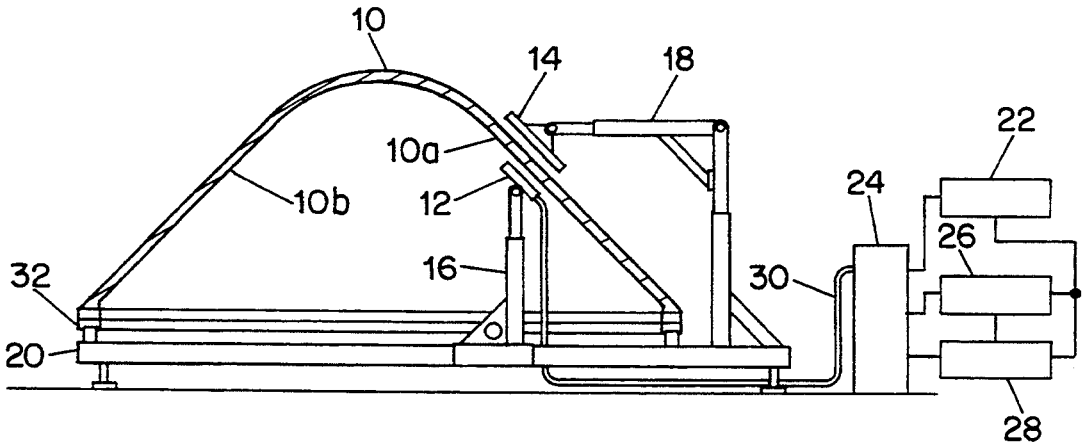
FIG. 1 shows a radome test system in accordance with the invention.

Referring now to FIG. 1, there is shown a radome test system utilizing the invention. A radome 10, to be tested, is shown in cross section, with the forward half removed for descriptive purposes. In a plan view the entire radome 10 has a circular form. As shown, the radome test system includes antenna means, shown as antenna 12, for providing a radiated test signal and for receiving a reflected test signal. Antenna 12 may be a small array of dipoles or a horn suitably proportioned for providing a defined beam pattern in the operating test frequency band. Also included is reflector means, shown as reflector 14 having a flat planar reflective surface. Reflector 14 is positioned in spaced relation to a selected area of the radome, identified as the area 10*a*. Thus, area 10*a* is a portion of the radome 10 lying between the antenna 12 and the reflector 14, which are respectively positioned in spaced relation to the inner and outer surfaces of area 10*a* of the radome. As shown, the reflector 14 is in a position for intercepting a radiated test signal provided by antenna 12, after such test signal passes through selected area 10*a* of the radome, and for reflecting the radiated test signal back to antenna 12, as a reflected test signal.

The FIG. 1 system also includes positioning means, illustrated as adjustable fixtures 16 and 18. In this embodiment, Fixture 16 is movably mounted to support structure 20 and supports antenna 12 in a position spaced from the wall of radome 10 and tilted so that signals are radiated in a direction substantially normal to the inner surface of the selected area 10*a* of the radome. Fixture 18 is correspondingly mounted to support structure 20 and supports reflector 14 in a position spaced from the wall of radome 10 and tilted so that the flat reflective surface of reflector 14 is substantially parallel to a plane tangent to a point on the outer surface of the selected area 10*a* of the radome. With this alignment, signals radiated from antenna 12 pass through selected area 10*a*, strike the flat surface of reflector 14 substantially normal thereto and are reflected back through selected area 10*a* of the radome for reception by antenna 12 operating in a receiving mode. During set-up of the test system, the alignment of reflector 14 can readily be varied so as to select the position which will substantially maximize the signals reflected back to the antenna 12. As will be further described, fixture 18 permits the position of reflector 14 to be adjusted relative to selected area 10*a* of the radome. In particular, fixture 18 enables the reflector 14 to be adjusted to positions which are successively a portion of a wavelength (e.g., approximately one-sixth wavelength) closer to or further from area 10*a*. Such adjustments may be made manually or may be automated by application of known techniques of position control technology.

As illustrated, FIG. 1 further includes data storage means, shown as memory 22 connected to electronics subsystem 24. Subsystem 24 generally controls and implements operation of the test system including generation of radiated test signals and processing of received reflected test signals. In cooperation with electronics subsystem 24, memory 22 is arranged to store signals and data relating to system operation, including data representative of signal transmission characteristics for the selected area 10*a* of the radome. In particular, such data may be derived based upon reflected test signals received while the reflector 14 is positioned at a plurality of positions (e.g., positions spaced by about one-sixth wavelength) in relation to the selected area of the radome.

The test system as shown additionally includes comparison means, shown as comparator 26 coupled to memory 22. As will be discussed with respect to system operation, reference data may be similarly obtained with respect to a reference area of the radome 10, for example reference area 10*b*, which has a symmetrical relationship on the opposite side of radome 10 from area 10*a*. Basically, if selected area 10*a* includes a portion of the radome which has been repaired, data representative of signal transmission characteristics for area 10*a* can be compared to data for symmetrically positioned reference area 10*b*, chosen because it remains in its original undamaged/unrepaired condition. Alternatively, standard data for a radome of the type under test can be obtained and stored in memory for comparison. In either case, data for area 10*a* can be subjected to comparison in comparator 26 in order to identify discrepancies in transmission characteristics of the repaired portion in selected area 10*a*.

The FIG. 1 system also comprises data processing means, shown as processor 28, for processing data representative of the reflected test signals (received by antenna 12) to derive reflection and transmission coefficients representative of signal transmission characteristics for selected area 10*a* of the radome. More particularly, processor 28 may be arranged to implement data analysis using data based on the received reflected test signals, or by automated procedures programmed into a computer, based upon analysis techniques such as will be described in greater detail below. Resulting data representative of signal transmission characteristics of the selected area 10*a*, which may include a repaired portion of the radome wall, can be stored in memory 22 for use in comparator 26 for comparison to corresponding data derived for a reference section of the radome wall or to reference data for the particular model of radome under test. On the basis of such comparisons it can be determined whether repairs to a portion of the radome wall have affected the signal transmission characteristics of the repaired portion. As illustrated, units 22, 26 and 28 may be interconnected and connected to electronics subsystem 24 to permit transfer, processing and storage of data under the control of unit 24. One or more coaxial transmission lines, shown at 30, are included for coupling signals between antenna 12 and electronics subsystem 24 in this embodiment.

The FIG. 1 system also includes placement means, shown as circular rotational support means 32, arranged to support the radome 10 along its circular edge (which is positioned horizontally in FIG. 1). Support means 32 permits antenna 12 and reflector 14 to be selectively positioned in proximity to any selected area of the radome 10. Thus, radome 10 is rotated in a horizontal plane to bring the desired area of the radome to the vicinity of antenna 12 and reflector 14. Fixtures 16 and 18 can then be adjusted in order to position the antenna 12 and reflector 14 to permit testing of the selected area of the radome (e.g., area 10*a* or area 10*b*). Additional cabling, control and monitoring components may be added to the FIG. 1 test set up as determined by persons skilled in the art. In the illustrated embodiment a relatively simple and inexpensive test set up enables collection of data which can be subjected to computer-based electronic analysis and comparison. In other embodiments more complex physical test fixtures and automated arrangements may be appropriate in application of known test implementation techniques to use of the present invention. As shown in FIG. 1, the selected area 10*a* comprises only a small portion of the overall surface area of the radome 10. While such selected area may be larger or smaller depending upon the particular embodiment of the invention, the selected area will typically be smaller than one-quarter of the overall area of the radome under test.

Figure 2:
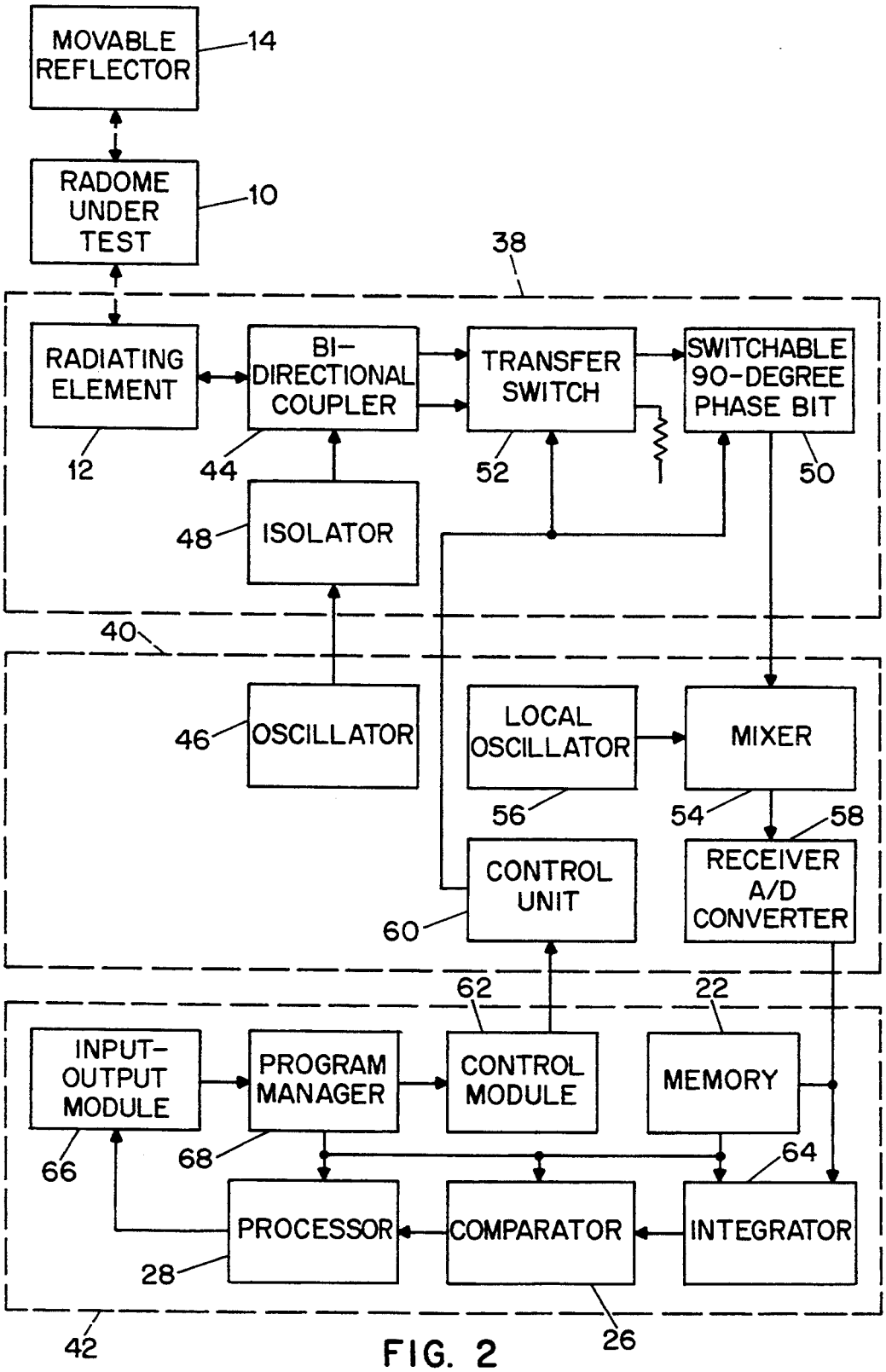
FIG. 2 is a functional block diagram of the FIG. 1 system.

With reference now to FIG. 2, there is illustrated a simplified functional block diagram of the FIG. 1 radome test system. While units 22, 26 and 28 are shown external to electronics subsystem 24 in FIG. 1 for descriptive purposes, it will be appreciated that the actual location of electronic components is a matter of choice. Thus, in practice, all electronics can be packaged together, data can be merely derived and stored at the test site and delivered in appropriate storage media for processing and analysis elsewhere, or other arrangements can be utilized as appropriate. In FIG. 2, reflector 14 is shown representationally on one side of radome 10, with antenna 12 and other components of the test system shown in three groupings. Thus, antenna 12 (labelled as radiating element 12) is illustrated as included in a sensor subsystem functional grouping 38, which is interconnected to a radio frequency (RF) signal subsystem grouping 40 and a signal processing subsystem grouping 42.

Briefly described, sensor grouping 38 includes antenna 12 and bi-directional coupler 44 for coupling signals to be radiated from oscillator 46, via isolator 48, and received signals to switchable 90° phase bit control circuit 50, via transfer switch 52. The components of sensor subsystem grouping 38 operate in known manner to provide for the sequential measurement of the in-phase and quadrature (real and imaginary) components of both the transmitted and reflected signals using a single receiver channel. This simplifies the measurement system by precluding the need for four matched channels which would otherwise be required. The bi-directional coupler 44 is a four port device having two coupled ports which couple a predetermined ratio, typically −20 to −30 dB, of the signal transmitted to and reflected from the antenna 12. The transfer switch 52 connects either of these coupled ports to the receiving system while terminating the other port in a matched load. This enables either the transmitted or the reflected signal to be selectively coupled to the mixer 54. RF signal subsystem grouping 40, in addition to oscillator 46, includes mixer 54 operating with a signal from local oscillator 56 to convert received signals to a lower frequency suitable for use in the receiver and analog-to-digital (A/D) converter 58. The A/D converter 58 generates a digital output which is proportional to that part of the signal voltage incident on the mixer 54 which is in phase with the signal from the local oscillator 56. When the switchable 90 degree phase bit 50 is set for zero insertion phase, the digital output is designated the in-phase (or real) component of the incident signal. When the switchable 90 degree phase bit 50 is set to impart 90 degrees additional insertion phase, the digital output is designated the quadrature (or imaginary) component of the incident signal. In this manner, all necessary measurements are performed using a single CW receiver channel. RF grouping 40 is shown as also including a control unit 60 for controlling operation of units 50 and 52. Control unit 60 may be a separately located unit under the control of control module 62 in the signal processing grouping, or may be integral with module 62. Signal processing subsystem grouping 42 includes memory unit 22, signal integrator 64, comparator 26, processor 28 and input-output module 66. These units, operating under the control and monitoring of program manager unit 68 implement the derivation of data representative of the signal transmission characteristics of the selected area 10*a* of the radome. The data is then available for coupling to a display or other analysis or read-out device via unit 66, which also enables reference or other data to be input to the system.

OPERATION

Figure 3:
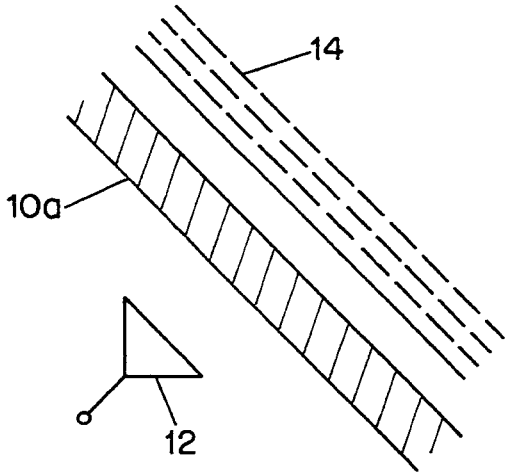
FIG. 3 is a conceptual drawing illustrating test positioning of elements of the FIG. 1 system.

The method of operation of the embodiment of the invention illustrated by the FIG. 1 radome test system includes the following steps. Under control of the program manager unit 68, antenna 12 is caused to radiate a test signal toward a selected area of the wall of radome 10. Such radiated test signal passes through the selected area 10*a* of the radome and is reflected by reflector 14 and received by antenna 12 (now operating in a receiving mode under control of sensor subsystem 38) after passing back through the selected area of the radome wall. After reception, frequency down-conversion and conversion to digital form by operation of mixer 54 and A/D converter 58, the reflected signals may be stored in memory 22 or used directly for purposes of analysis. The foregoing steps are then repeated after reflector 14 is repositioned to a different spacing from the outer surface of selected area 10*a* of the radome. More specifically, the reflector may be successively moved to a distance equal to a portion of a wavelength (typically less than one-half wavelength, with one-sixth wavelength considered a suitable example) at a frequency in a relevant frequency band to permit reflected signals to be received from a total of three or four different spacings of reflector 14 as conceptually illustrated in FIG. 3. The resulting data is then plotted as data points on a Smith chart or similar type of impedance analysis chart, or such data plotting and analysis are carried out in an analogous type of computer-based data computation. In this way, data representative of signal transmission characteristics, such as transmission amplitude and phase and back-scattered reflection amplitude and phase, can be derived and stored. Such data enables the specific or absolute evaluation of the characteristics of the selected area. In accordance with the invention, the data with respect to a selected area of the radome can also be compared to reference data in order to determine if transmission characteristics for the selected area differ from predetermined specification levels or limits applicable to the type or model of radome under test. Such reference data may take the form of standardized data specified as a result of far field antenna pattern testing of a radar system utilizing the type or model of radome in point. Alternatively, such reference data may be derived on the basis of measurements performed on a radome which has previously passed testing and been certified as acceptable for use in a weather radar system, for example, or for use under more critical performance criteria applicable to radars for use in windshear monitoring applications. The derivation of such data from a previously certified radome may be carried out by testing of an undamaged reference area of a radome, such reference area preferably having a symmetrical relationship on the radome, as compared to a selected area. If the selected area includes a repaired portion of radome wall, comparison of transmission characteristic data for the reference and damaged portions permits evaluations of any differences in such data.

The determination of transmission characteristics using the above-described measurement technique in accordance with the invention, methods for calibration of the radome test system, and techniques for use of the system in testing radomes will now be discussed. The method for measuring the properties of radomes, and particularly repaired radome sections, takes into consideration the interaction of measurement system components with the radome under test. These interactions would otherwise cause prohibitively large errors, since acceptable radomes for weather radars typically exhibit better than 90% power transmission, or about 0.5 dB loss. To perform the appropriate measurements with compatible accuracy would normally require unrealistically low component VSWR. The mathematical techniques for circumventing these detrimental interaction effects are based on network theory and adapted from similar techniques commonly employed with automatic network analyzers.

Figure 4A:
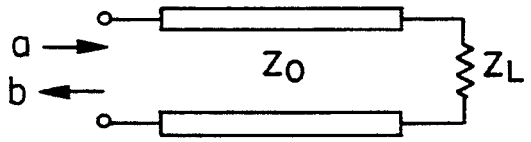
FIGS. 4*a* and 4*b* are equivalent circuit diagrams useful in describing operation of the invention.

To compute the transmission, reflection and dissipation characteristics of a radome section using the radome test system or "tester", the antenna incorporated in the sensor assembly is viewed as radiating into a lossy transmission line. FIG. 4*a* illustrates this approach for the normal operation of an antenna. Power radiated by the antenna propagates through the lossy line $Z_o$ to a receiving antenna located at a distance d' and represented as the load $Z_L$. If the receiving antenna is in the far field, the loss is computed by the beacon equation. If the receiving antenna is in the near field, an equivalent near-field calculation is used to determine the loss. In either case, the load $Z_L$ is not necessarily matched to the transmission line, and the model thus facilitates the evaluation of interactions between the two antennas.

Figure 4B:
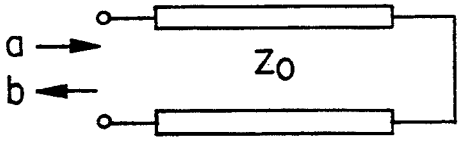

FIG. 4*b* schematically depicts the antenna radiating into a flat reflector in the form of a metallic plate as used in the radome tester. The observed reflection coefficient at the antenna is defined as the ratio of the signal received to that transmitted, and is expressed as: $\Gamma = -A_L \exp[2jkd']$ where k is the propagation constant $2\pi/\lambda$, d' is the distance to the metallic plate, and $A_L$ is the round-trip attenuation, or loss, of the line. The latter is computed using a near-field analysis of the antenna characteristics, or alternatively, is measured using a procedure similar to that described by Silver (Microwave Antenna Theory and Design, McGraw-Hill, New York, 1949, pp.582–592).

Based upon values of round-trip attenuation $A_L$ as a function of the antenna-to-plate separation normalized to operating wavelength, the variation of attenuation with separation can be evaluated for different test antenna apertures. With a matched antenna having a uniformly illuminated hexagonal aperture, a baseline aperture of 4.5 λ is considered appropriate for the radome tester. Such an aperture limits system radiation losses to 2 dB for antenna-to-plate separations up to 9 λ.

Figure 5:
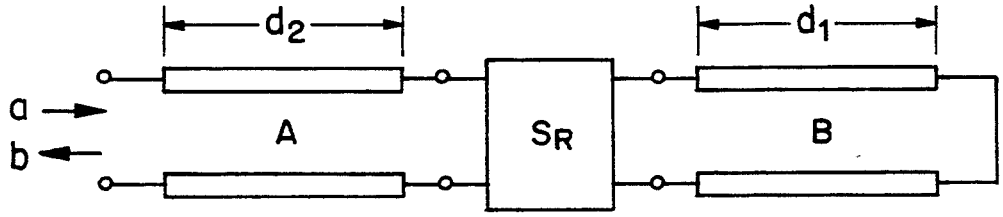
FIG. 5 shows a transmission line model useful in describing the invention.

The analysis of the radome tester operation is based on the transmission line model pictured in FIG. 5. The measurement system is fundamentally a cascade of three networks: a transmission line A from the antenna to the radome, the radome itself represented by the scattering matrix $S_R$, and a transmission line B with a short-circuit load. The radome scattering matrix is reciprocal and has the form:

$$S_R = \begin{bmatrix} js_{11}\exp[2j\alpha] & s_{12}\exp[j(\alpha+\beta)] \\ s_{12}\exp[j(\alpha+\beta)] & js_{11}\exp[2j\beta] \end{bmatrix}$$

where all quantities are real, and where $s_{11}$ is the reflection coefficient, $s_{12} \neq 0$ is the transmission coefficient, and $\alpha$ and $\beta$ are arbitrary phase angles which are interpreted in network theory as reference plane designators. To maintain energy conservation, $s_{11}$ and $s_{12}$ are further constrained such that $$L = 1 - s_{11}^2 - s_{12}^2$$

where L is the dissipation factor or relative power dissipated in the radome with $0 \leqq L < 1$.

Networks consisting of cascaded elements are conveniently solved using a transfer matrix representation. The scattering matrix S and the transfer matrix T of a two-port network are defined as:

$$\begin{bmatrix} b_1 \\ b_2 \end{bmatrix} = S \begin{bmatrix} a_1 \\ a_2 \end{bmatrix} \quad \begin{bmatrix} b_2 \\ a_2 \end{bmatrix} = T \begin{bmatrix} a_1 \\ b_1 \end{bmatrix}$$

where $a_1$ and $a_2$ are the input signals to the network, and $b_1$ and $b_2$ are the output signals. Therefore, the transfer matrix of the radome is:

$$T_R = \frac{1}{s_{12}} \begin{bmatrix} (s_{12}^2 + s_{22}^2)\exp[j(\alpha+\beta)] & js_{11}\exp[-j(\alpha-\beta)] \\ -js_{11}\exp[j(\alpha-\beta)] & \exp[-j(\alpha+\beta)] \end{bmatrix}$$

The complete transfer representation of the network of FIG. 5 thus becomes:

$$\begin{bmatrix} b \\ a \end{bmatrix} = \begin{bmatrix} A_2\exp[jkd_2] & 0 \\ 0 & \exp[-jkd_2]/A_2 \end{bmatrix} T_R \begin{bmatrix} -A_1\exp[2jkd_1] \\ 1 \end{bmatrix}$$

where $d_1$ is the distance between the radome and the metallic plate reflector and $A_1$ is the round-trip attenuation in this span, where $d_2$ is the distance between the antenna and the radome and similarly $A_2$ is the associated one-way attenuation, and where a and b are the input and output signals at the antenna aperture. The latter define the reflection coefficient observed at the antenna: $\Gamma = b/a$. For the complete test system, the cascade can be augmented to include the antenna itself and attached microwave components and cables. The equation in matrix form is then:

$$V = T\,T_R V_L \tag{1}$$

where V is the vector representation of the signals at the input port, T is the transfer matrix encompassing all components and lines between the input port and the radome, $T_R$ is the transfer matrix of the radome, and the vector $V_L$ represents the load imposed by the metallic plate and the transmission line between the plate and the radome. To afford a comprehensive representation of the equipment design, the input port is placed at a bi-directional coupler included in the system. The formulation thus facilitates the evaluation of design considerations for specific test systems and of tolerance requirements.

The transfer matrix representation further affords the basis for determining the specific tests and associated computations which are to be used to calibrate the radome tester and to measure radome parameters. This determination is based on two fundamental empirical procedures: (1) the procedure for evaluating the unknown S-parameters of a two-port network from reflection coefficient measurements with a known load, and (2) the procedure, commonly called "de-embedding" for transferring measured reflection coefficient data forward through a network with a known transfer matrix.

With regard to the former procedure, the measurement process is described by the matrix equation:

$$C\begin{bmatrix}\Gamma\\1\end{bmatrix}=\begin{bmatrix}t_{11} & t_{12}\\ t_{21} & t_{22}\end{bmatrix}\begin{bmatrix}\Gamma_o\\1\end{bmatrix}$$

where the $t_{mn}$s are the elements of the unknown transfer matrix in which port 2 is designated the input port where the measurements are performed, $\Gamma_o$ is the reflection coefficient of the known load, $\Gamma$ is the reflection coefficient measured at the input of the unknown transfer matrix, and C is an unknown proportionality constant. This matrix equation reduces to the linear equation:

$$\Gamma_o t_{11}+t_{12}-\Gamma_o\Gamma t_{21}-\Gamma t_{22}=0$$

which defines the interrelationship of the unknown transfer matrix elements. In general, three independent measurements with three different loads produce three independent linear equations. These are solved as simultaneous equations to obtain the relative values of the unknown transfer matrix elements $t_{mn}$. The transfer matrix elements are then used to determine the scattering matrix of the reciprocal network as follows.

Let $t_{22}$ be the reference value, and redefine the unknowns as: $\tau_1=\tau_{12}/\tau_{22}$, $\tau_2=t_{21}/\tau_{22}$, and $\tau_3=\tau_{11}/\tau_{22}$. For the nth measurement, the above linear equation then takes the form:

$$\tau_1-\Gamma_o^{(n)}\Gamma^{(n)}\tau_2+\Gamma_o^{(n)}\tau_3=\Gamma^{(n)} \quad (2)$$

where the superscript (n) indicates the nth measurement in a series of N measurements. Three independent equations of this form, corresponding to each of three measurements with different loads, are solved for $\tau_1$, $\tau_2$ and $\tau_3$. Then, by applying the relationship between the scattering matrix and the transfer matrix, imposing reciprocity conditions and substituting $\tau_1$, $\tau_2$ and $\tau_3$, the unknown scattering matrix is obtained:

$$S=\frac{1}{t_{22}}\begin{bmatrix}-t_{21} & 1\\ t_{11}t_{22}+t_{12}t_{21} & t_{12}\end{bmatrix}= \quad (3)$$

-continued $$\begin{bmatrix}-\tau_2 & \sqrt{\tau_3-\tau_1\tau_2}\\ \sqrt{\tau_3-\tau_1\tau_2} & \tau_1\end{bmatrix}$$

Thus, the unknown S-parameters of a reciprocal network are evaluated experimentally by three reflection coefficient measurements with known loads. From the S-parameters, not only the scattering matrix but also the corresponding transfer matrix are completely defined.

Figure 6:
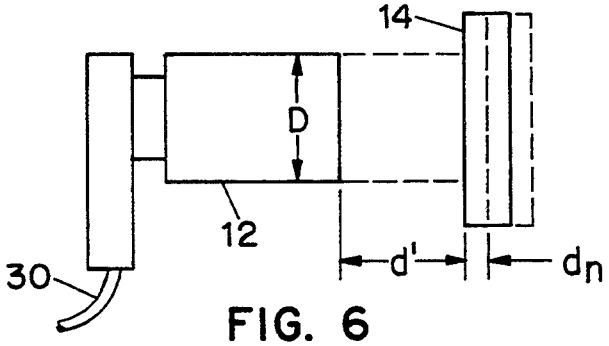
FIG. 6 illustrates system alignment for factory calibration procedures.
Figure 7A:
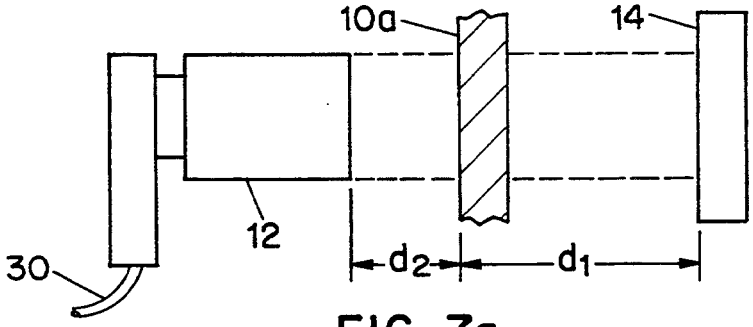
FIG. 7*a* illustrates a physical test system set up for radome measurement and FIG. 7*b* shows the transmission line model relating to such tests with the calibrated test system.
Figure 7B:
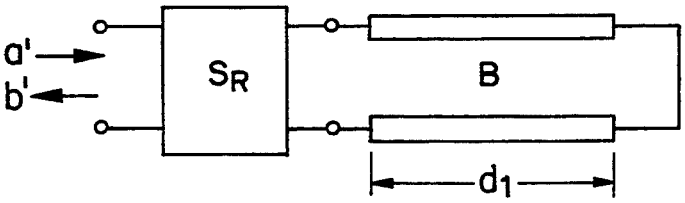

This procedure is used for factory calibration of the radome tester. In calibration, a convenient reference plane in front of the antenna is chosen. For the baseline design, the antenna aperture $D=4.5\ \lambda$ in FIG. 6, the chosen reference plane is $2.4\ \lambda$ in front of the antenna aperture, that is, reflector 14 is placed in front of antenna 12 at $d'=2.4\ \lambda$, where the field is comparatively insensitive to positional tolerances. For production systems, an equivalent selection criterion utilizes field probe measurements performed at the factory. The movable short assembly, containing the metallic reflector is placed at the reference plane and aligned to the antenna as illustrated in FIG. 6. The reflection coefficient $\Gamma$ is measured at the bi-directional coupler. The reflection coefficient of the load is: $\Gamma_o=-1$, which corresponds to the short-circuit impedance produced by the metallic plate. Additional measurements are performed after moving the plate outward from the antenna. The corresponding reflection coefficient of the load is:

$$\Gamma_o^{(n)}=-F_n^2\exp[2j\phi_n]$$

where $F_n\exp[j\phi_n]$ is the free-space electric field integrated at the plane of the metallic reflector relative to that at the reference plane. However, because the field of the antenna is comparatively stationary at the chosen reference plane, and because the metallic reflector is displaced at most $\lambda/2$ during calibration the reflection coefficient of the load simplifies to:

$$\Gamma_o^{(n)}=-\exp[2jkd_n]$$

where $d_n$ is the distance from the reference plane to the metallic plate for the nth measurement. To maximize the accuracy of the calibration, the $d_n$s are approximately $\lambda/6$ apart. Thus, $d_n$ in FIG. 6 would successively have values of $d_1=0$, $d_2=1/6\ \lambda$ and $d_3=\frac{1}{3}\ \lambda$. This maximizes the dispersion of the measured reflection coefficient data. In this manner, three independent linear equations containing only $\tau_1$, $\tau_2$ and $\tau_3$ as unknowns are created. These equations are solved by Cramer's method, or another equivalent method, and the transfer matrix T defining the composite transfer characteristics of all system components is determined. Since this transfer matrix has thus become a known quantity, it may be de-embedded from all subsequent measurements.

The capacity for de-embedding is a major attribute of transfer matrix formulations. The performance of a cascade of M networks is represented by the matrix equation:

$$V_1=T_1T_2\ldots T_MV_L$$

where $T_m$ is the transfer matrix of the mth network, $V_L$ is the voltage vector of the load, and $V_1$ is the voltage vector observed at the input terminals of the first network. Designating port 2 of any two-port network as its input port, the voltage vector $V_1$ is defined as:

$$V_1 = \begin{bmatrix} b_{21} \\ a_{21} \end{bmatrix} = T_1 \begin{bmatrix} a_{11} \\ b_{11} \end{bmatrix} = T_1 \begin{bmatrix} b_{22} \\ a_{22} \end{bmatrix} = T_1 V_2$$

where $a_{1m}$, $a_{2m}$, $b_{1m}$ and $b_{2m}$ are the signals incident on and reflected from the mth network port as previously defined, and where $V_2$ is the voltage vector at the terminals of the second network. Then, clearly, $$V_2 = T_1^{-1} V_1 \; V_3 = T_2^{-1} V_2 \ldots . \; V_L = T_M^{-1} V_M$$

where the exponent $-1$ designates the inverse matrix. In this manner, by formulating a transfer matrix construct for cascaded two-port networks, it is possible to compute the signal flow anywhere within the cascade.

Applying these principles to the radome tester, if $T_1$ is the transfer matrix obtained in the aforementioned calibration, measured data can be transferred to the reference plane simply by multiplying by the inverse of $T_1$ and renormalizing as follows:

$$C \begin{bmatrix} \Gamma' \\ 1 \end{bmatrix} = \begin{bmatrix} b' \\ a' \end{bmatrix} = T_1^{-1} \begin{bmatrix} \Gamma \\ 1 \end{bmatrix} \quad (4)$$

where $\Gamma$ is the measured reflection coefficient for any condition of the radome tester, $\Gamma'$ is the equivalent reflection coefficient data transferred to the reference plane, a' and b' are respectively the signals incident on and reflected from the reference plane, and C is a proportionality constant which in effect normalizes a' to unity. This calibration is performed at the factory and the results stored in computer memory. Using the stored data, subsequent measurements compensate for all interactions within the measurement system.

To ultimately report meaningful radome parameters, it is desirable to reference tester data to the radome itself, and to enhance the utility of the tester and simplify its operation, it is further desirable to place the radome anywhere in the near-field of the tester antenna. To afford these features, a second step is provided in the factory calibration procedure. Referring again to FIG. 6, this step involves moving the metallic plate to multiple locations in front of the antenna and measuring the reflection coefficient as referenced to the reference plane of the first calibration step described above. The plate-to-antenna separation d' is varied from a minimum of approximately one wavelength to a maximum of 12 to 15 λ for the baseline design. This encompasses the range of plate-to-antenna separations and radome-to-antenna separations encountered in normal radome measurements. The calibration measurement thus experimentally establishes the round-trip attenuation and insertion phase of the near-field transmission line. From this data, transfer matrices to corresponding planes in the near-field of the antenna are constructed as:

$$T_2(d') = \begin{bmatrix} \Gamma^{\frac{1}{2}}(d') & 0 \\ 0 & \Gamma^{-\frac{1}{2}}(d') \end{bmatrix}$$

where $\Gamma(d')$ is the complex reflection coefficient measured with the metallic plate a distance d' from the antenna as referenced to the plane previously defined in the first calibration step. The measured F(d') data is stored in memory in the system computer at sufficiently small increments to allow accurate interpolation to any value of d' within the system's operational range.

In operation, the radome tester uses the stored results of the first and second steps of the factory calibration procedure to reference measured data to the radome surface. The composite transfer matrix of all components and transmission lines between the radome and the bi-directional coupler, expressed as a function of $d_2$, the distance between the radome and the antenna aperture, is:

$$T(d_2) = T_1 T_2(d_2)$$

where $T_1$ is obtained from the first calibration step and $T_2$ is obtained from the second calibration step. The transfer matrix T is the same as that of equation (1). During set-up of the tester for radome measurements, $d_2$ is measured and the corresponding $T_2$ matrix is computed using the stored reflection coefficient data F(d') from factory calibration. The resultant $T_2$ matrix is multiplied with the stored $T_1$ matrix to obtain T for the measurement configuration. Data subsequently measured is referenced to the plane of the radome by equation (4) with $T_1$ equal to T. Equation (1) thus becomes:

$$V^l = T_R V_L$$

where V' is now the measured voltage vector at the radome, from which the reflection coefficient is evaluated as:

$$\Gamma' = b'/a'.$$

Typical measurements performed on a radome section are schematically depicted in FIGS. *7a* and *7b*. FIG. *7a* shows the physical set-up corresponding to the transmission line model of FIG. 5. Using the mathematical methods described above, the data referenced to the radome now pertains to the model of FIG. *7b*. Three independent measurements are made by appropriately positioning the metallic plate reflector of the movable short assembly. Again, choosing three positions approximately λ/6 apart maximizes the accuracy of the measurements by maximizing the dispersion of the reflection coefficient data. This data is used to form three linear equations relating $\tau_1$, $\tau_2$ and $\tau_3$ per equation (2) where $\Gamma^{(n)}$ is the measured reflection coefficient for the nth plate position referenced to the radome, and where the load reflection coefficient for the nth plate position is defined as:

$$\Gamma_o^{(n)} = \Gamma(d_{1n} + d_2)/\Gamma(d_2)$$

where $\Gamma(d_2)$ and $\Gamma(d_{1n}+d_2)$ are the stored reflection coefficients for the radome position: $d' = d_2$, and for the metallic plate position: $d' = d_{1n} + d_2$, respectively. The resultant equations are solved for $\tau_1$, $\tau_2$ and $\tau_3$, and the solutions are used to evaluate the radome scattering matrix per equation (3). The elements of the scattering matrix are subsequently analyzed to determine the power transmission coefficient, the power reflection coefficient, the dissipation factor and the insertion phase of the radome section under test.

FIGS. 8 AND 9

Figure 8:
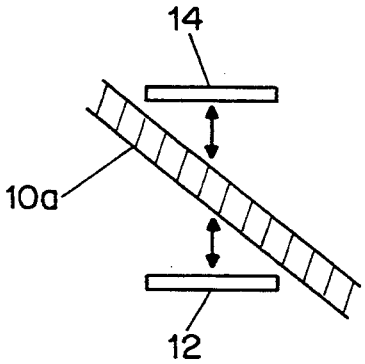
FIGS. 8 and 9 respectively show alternative positioning and usage of elements of the FIG. 1 radome test system.

With an understanding of the present invention, other embodiments will be readily implementable by persons skilled in the areas of antenna and test technology. FIG. 8 illustrates an arrangement wherein antenna 12 and reflector 14 have been repositioned relative to radome 10 so that the test signal radiated by antenna 12 and the reflected test signal from reflector 14 both pass through the radome wall along a substantially vertical path. It will be appreciated that with radome 10 positioned with its circular mounting rim horizontal, as shown in FIG. 1, the boresight beam radiation axis of the radome will be vertical (i.e., corresponding to the boresight beam axis of the radar antenna which the radome is designed to cover). Thus, with the FIG. 8 alignment, testing will be carried out utilizing a radiated and reflected test signal propagation direction corresponding to the basic propagation direction of radar signals under actual use conditions of the radome.

Figure 9:
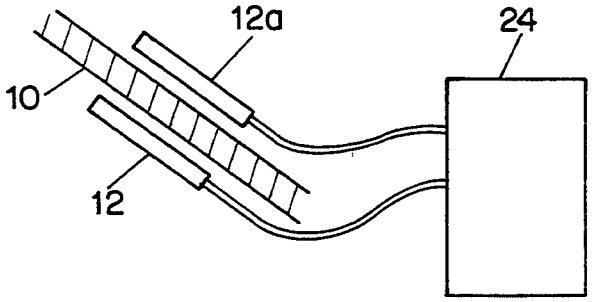

FIG. 9 shows an arrangement in which reflector 14 of FIG. 1 is replaced by a second antenna 12*a*, similar or identical to the original antenna 12. With this arrangement information representative of signal transmission characteristics is derived from test signals radiated by one antenna and received by the other antenna after having been transmitted through the radome wall only once. A need for precise identity of performance of the two antennas 12 and 12*a* can be avoided by use of the selected area/reference area comparison technique previously described. Thus, test signal transmission data can be derived for both a selected area, including a repaired portion of radome wall, and a reference area having a position on the radome which has a symmetrical relationship to such selected area. Discrepancies in the test data for the two areas is then indicative of departure of transmission characteristics of the repaired portion from desired or specified values, while derivation of absolute transmission values is not required. Those skilled in the art will recognize that measurements made using distinct transmitting and receiving antennas are influenced by interactions between the antennas themselves and the intervening radome, materially affecting the measured values. The effect of these interactions can be reduced or removed by multiple measurements for several different positions of these components.

In application of the invention any suitable form of antenna, comprising one or more dipoles or horns arranged in an array or other configuration, for example, can be employed to provide radiated test signals. Typically the frequency of the radiated test signals will be chosen to correspond to one or more frequencies in the intended operating frequency band of the radome. Also, in particular embodiments a reflector 14 having a curved cross section may be substituted for the planar reflector shown, in order to provide additional beam focusing capability. While the test set-up has been described with specific reference to only a single positioning of antenna 10 relative to testing of a particular selected area 10*a*, in practice it will usually be desirable to take test data with the antenna and reflector successively positioned so that signals pass through the radome at different points within or adjacent to the selected area. By such testing at different frequencies or different positions, or both, an improved evaluation of the possible existence of localized imperfections may be obtained. The invention has been described with particular reference to re-testing of areas of a radome which has previously been tested on a full-capability antenna range and certified as meeting performance specifications. In other applications, pre-recorded reference data for a given model of radome may be used for initial certification testing of radomes at the end of the manufacturing process, thereby avoiding the need for antenna range testing of individual radomes of a production model. In either of these cases, the derived data representative of signal transmission characteristics of the selected section is made available for comparison with reference data which is representative of specified or standard signal transmission characteristics for the radome (specifically or for the radome model or type in point).

While there have been described the presently preferred embodiments of the invention, those skilled in the art will recognize that other and further modifications and variations may be made without departing from the invention. It is therefore intended to claim all such modifications and variations as fall within the scope of the invention.

What is claimed is:

1. A radome test system, for determining signal transmission characteristics for a selected area of a radome, comprising:

antenna means for providing a radiated test signal and for receiving a reflected test signal;

reflector means, positioned in spaced relation to said selected area of said radome, for intercepting said radiated test signal after it passes through said selected area of said radome and for reflecting said radiated test signal back to said antenna means as a reflected test signal;

positioning means, coupled to said reflector means, for adjusting the position of said reflector means relative to said selected area of said radome; and data storage means, coupled to said antenna means, for storing data representative of signal transmission characteristics for said selected area of said radome based upon reflected test signals received by said antenna means while said reflector means is positioned at a plurality of positions in relation to said selected area of said radome.

2. A radome test system as in claim 1, additionally comprising comparison means, coupled to said data storage means, for enabling comparison of said data for said selected area to similar data for a reference area, of said radome, which has a symmetrical relationship to the position of said selected area on said radome.

3. A radome test system as in claim 1, additionally comprising comparison means, coupled to said data storage means, for enabling comparison of said data for said selected area to reference data representative of standard signal transmission characteristics.

4. A radome test system as in claim 1, additionally comprising data processing means, coupled to said data storage means, for processing data representative of said reflected test signals received by said antenna means to derive reflection and transmission coefficients representative of signal transmission characteristics for said selected area.

5. A radome test system as in claim 1, additionally comprising placement means for selectively positioning said antenna means and said reflecting means in proximity to a selected area of said radome which includes a portion of said radome which has been repaired and to a reference area which includes no repaired portion and is an area having a position on said radome which has a symmetrical relationship to the position of said selected area on said radome.

6. A radome test system as in claim 1, wherein said reflector means comprises a flat reflective surface positioned substantially parallel to a plane tangent to a point on the surface of said selected area of said radome, and said positioning means is arranged to adjust the position of said reflector means along a line normal to said plane.

7. A radome test system as in claim 6, wherein said positioning means is arranged to adjust the position of said reflector means along said line normal to said plane in predetermined increments equal to portions of a wavelength at a predetermined frequency.

8. A radome test system as in claim 1, wherein said reflector means comprises a flat reflective surface positioned substantially normal to the boresight beam radiation axis of the radome, and said positioning means is arranged to adjust the position of said reflector means along a line parallel to said axis.

9. A radome test system as in claim 8, wherein said positioning means is arranged to adjust the position of said reflector means along said line parallel to said axis in predetermined increments equal to portions of a wavelength at a predetermined frequency.

10. A radome test system, for determining signal transmission characteristics for a selected area equal to less than one-quarter of the overall area of a radome, comprising:

radiating means, selectively positionable in spaced relation to said selected area of said radome, for providing a radiated test signal;

receiving means, selectively positionable in spaced relation to said selected area of said radome, for receiving said radiated test signal after transmission through said selected area of said radome;

data storage means, coupled to said receiving means, for storing data derived from said radiated test signals received by said receiving means, said data being representative of signal transmission characteristics for said selected area of said radome; and comparison means, coupled to said data storage means, for comparing said data representative of signal transmission characteristics for said selected area to reference data representative of specified signal transmission characteristics for said radome.

11. A radome test system as in claim 10, wherein said radiating means and said receiving means comprise the same antenna means, which is used both for radiating said radiated test signal and for receiving said radiated test signal, and additionally including reflector means, positioned in spaced relation to said selected area of said radome, for intercepting said radiated test signal after transmission through said selected area of said radome and for reflecting said radiated test signal back to said receiving means.

12. A radome test system as in claim 11, wherein said antenna means is an array of dipoles.

13. A radome test system as in claim 10, additionally including placement means, coupled to said radiating means and said receiving means, for selectively positioning said radiating means and receiving means in spaced relation to said selected area of said radome to enable said radiated test signal provided by said radiating means to be received by said receiving means after transmission of said radiated test signal through said selected area of said radome.

14. A radome test system as in claim 10, wherein said data storage means is arranged for storing phase and amplitude data representative of said signal transmission characteristics.

15. A method for determining signal transmission characteristics for a selected area of a radome, comprising the steps of:

(a) radiating a test signal toward said selected area of said radome;

(b) reflecting said test signal from a predetermined first reflection position, after said test signal has passed through said selected area of said radome, to provide a reflected test signal;

(c) receiving said reflected test signal;

(d) storing data representative of said reflected test signal received in step (c);

(e) repeating steps (a) through (d) with said predetermined first reflection position changed to a predetermined second reflection position; and (f) processing said stored data to provide data representative of signal transmission characteristics for said selected area of said radome.

16. A method as in claim 15, wherein step (e) includes changing said first reflection position to a second reflection position which is separated from said first reflection position by a distance equal to a portion of a wavelength at a predetermined frequency.

17. A method as in claim 15, wherein step (e) comprises repeating steps (a) through (d) a total of two times with said predetermined first reflection position changed to successive second and third reflection positions with inter-position separation increments each equal to one-sixth wavelength at a predetermined frequency.

18. A method as in claim 15, wherein step (f) includes deriving phase and amplitude data representative of signal transmission characteristics of said selected area of said radome.

19. A method as in claim 15, additionally comprising the steps of:

(g) repeating steps (a) through (f) for a reference area having a position on said radome which has a symmetrical relationship to the position of said selected area on said radome; and (h) comparing said data representative of signal transmission characteristics for said selected and reference areas of said radome to identify differences in said characteristics for said areas.

20. A method as in claim 15, additionally comprising the step of:

(g) comparing said data representative of signal transmission characteristics for said selected area of said radome to reference data representative of predetermined signal transmission characteristics.

* * * * *